United States Patent [19]

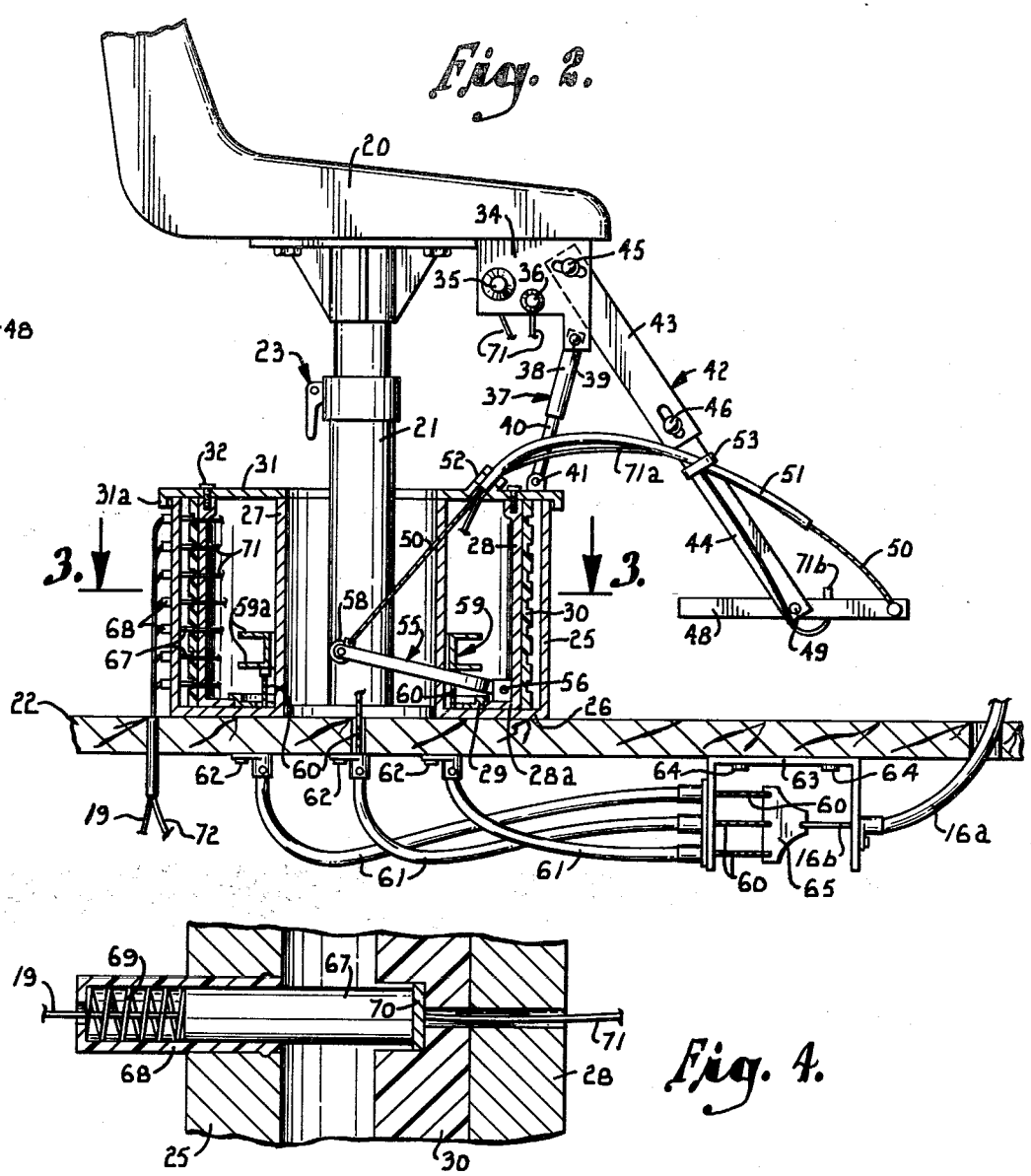
Fig. 2.
3.
3.
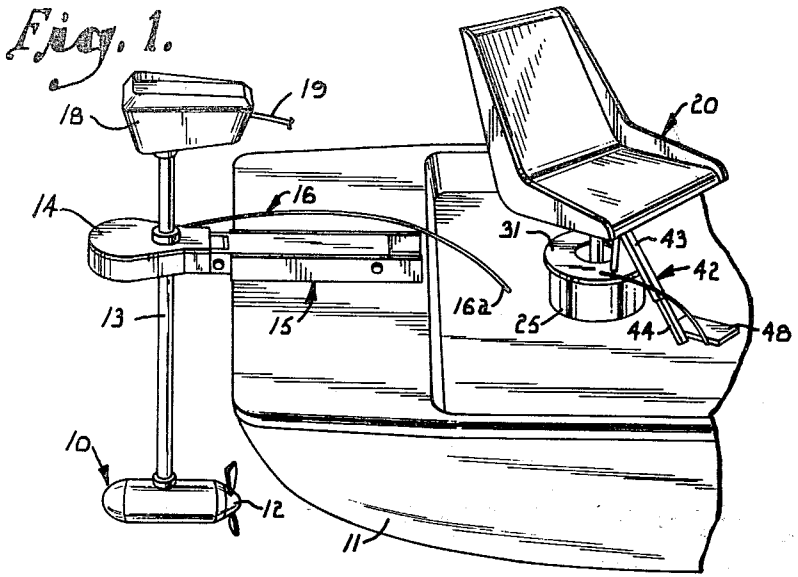
Fig. 1.
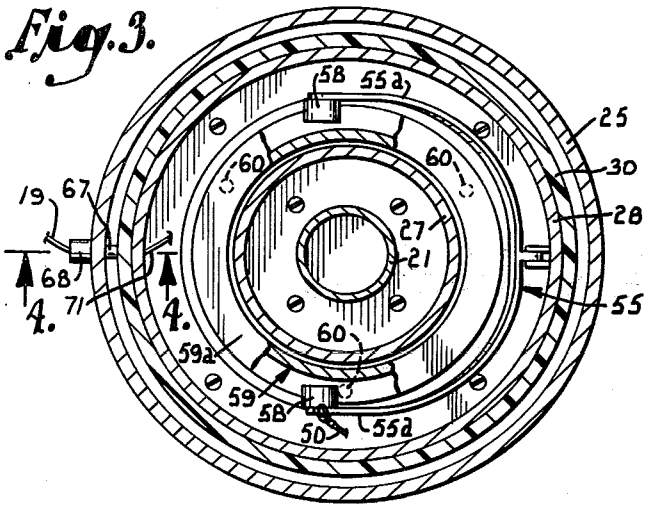
Fig. 3.
4.
4.
Fig. 4.

Jones

[11] 4,143,436

[45] Mar. 13, 1979

[54] DIRECTIONAL CONTROL MECHANISM FOR A TROLLING MOTOR

[76] Inventor: Roy E. Jones, 548 Powahatan, Independence, Mo. 64056

[21] Appl. No.: 774,391

[22] Filed: Mar. 4, 1977

[51] Int. Cl.[2] ..... B63B 29/00; B63H 21/26

[52] U.S. Cl. ..... 9/7; 114/153; 115/18 E; 297/349; 297/429

[58] Field of Search ..... 115/18 E, 18 R; 114/144 R, 144 A, 153; 9/7; 74/501 R, 512, 515 R; 180/77 S; 244/86; 297/330, 349, 429

[56] References Cited

U.S. PATENT DOCUMENTS

| | | | |
|---|---|---|---|
| 2,968,273 | 1/1961 | Corbett et al. | 114/153 |
| 3,002,398 | 10/1961 | Beamer | 114/153 |
| 3,151,910 | 10/1964 | Larson | 9/7 |
| 3,889,625 | 6/1975 | Roller et al. | 114/153 |
| 4,008,500 | 2/1977 | Hall, Jr. | 115/18 E |

*Primary Examiner*—Trygve M. Blix
*Assistant Examiner*—Stuart M. Goldstein
*Attorney, Agent, or Firm*—Lowe, Kokjer, Kircher, Wharton & Bowman

[57] ABSTRACT

A pedal operated control mechanism for controlling the direction of travel of a fishing boat. In order to remain at a location convenient to the fisherman, the pedal is mounted on a bracket arm which rotates with the boat seat. The pedal has a control wire which enters a stationary control housing and which raises and lowers a pair of lever arms as the wire extends and retracts. The lever arms raise and lower a ring which in turn causes extension and retraction of a main control cable in order to change the direction of the trolling motor. A sliding brush assembly provides continuous electrical connection between rotating conductor wires on the seal assembly and stationary conductor wires which apply current to the trolling motor.

12 Claims, 4 Drawing Figures

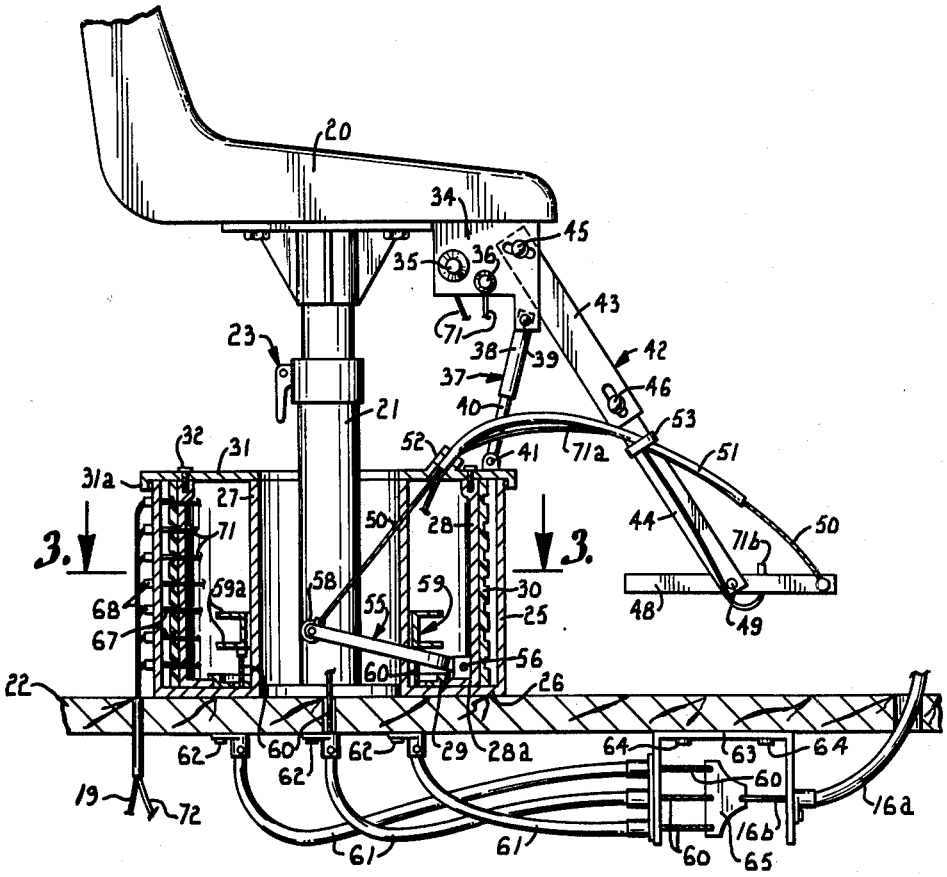

DIRECTIONAL CONTROL MECHANISM FOR A TROLLING MOTOR

BACKGROUND AND SUMMARY OF THE INVENTION

This invention relates in general to the directional control of an electric trolling motor of a fishing boat. More particularly, the invention deals with a pedal operated directional control unit wherein the pedal rotates with the boat seat on which the fisherman sits while fishing.

Small outboard electric motors commonly known as trolling motors are widely used on fishing boats because they are able to propel the boat noiselessly through the water without alarming the fish. Ordinarily, the power for driving these trolling motors is supplied by a battery which is carried on board the boat.

The propulsion unit usually includes a sealed DC motor which is submerged in the water and which drives a propeller in order to provide the motive force for powering the boat. Typically, the propulsion unit is carried on the bottom end of a vertical mounting shaft which is adjustable in order to vary the motor depth. In order to free the hands of the fisherman, most trolling motors have a pedal operated directional control mechanism which allows the direction of travel of the boat to be changed by depression of a pedal lever. Pivotal movement of the pedal extends and retracts a control cable which is coupled to the mounting shaft in a manner to turn it and thus vary the direction of the propulsion unit.

Although these foot operated control systems have achieved considerable popularity because they provide the fisherman with free use of his hands, they have not been entirely satisfactory in all respects. For example, the pedal lever is normally mounted on the boat deck so that it is difficult and in some cases impossible to reach when the fisherman rotates in his chair to a position away from the pedal location, as occurs frequently when fishing for bass. There have been attempts made to mount the pedal such that it swivels with the boat seat; however; these efforts have failed to solve the problem in a practical manner. Existing arrangements of this type permit the boat seat to swivel only to a limited extent rather than through a full 360° as is often necessary in catching bass and other fish. Moreover, as the boat seat swivels, the control cables and electrical wires extending from the pedal and seat assembly become wrapped around the base of the seat and become entangled in other nearby equipment.

Consequently, a need remains for a convenient and effective directional control mechanism for an electric trolling motor. It is the primary goal of the present invention to fulfill that need.

More specifically, it is an object of the invention to provide a directional control mechanism in which the control pedal rotates with the boat seat in order to remain conveniently accessible to the fisherman regardless of the rotative position of the seat.

Another object of the invention is to provide a directional control mechanism that includes reliable and effective means for transmitting pivotal movement of the pedal into extension and retraction of a nonrotating main control cable which acts to vary the direction of the trolling motor.

Still another object of the invention is to provide a control mechanism of the character described in which an operating cable associated with the pedal rotates in unison with the boat seat so as to avoid entanglement with the seat base or other equipment.

In conjunction with the preceding object, it is a further object of the invention to provide a control mechanism of the character described in which the electrical wiring rotates with the seat assembly in order to prevent it from winding around the seat structure.

An additional object of the invention is to provide, in a control mechanism of the character described, an electrically conductive brush assembly which continuously maintains the necessary electrical connections without interfering with rotational movement of the seat and pedal assembly.

Yet another object of the invention is to provide a control mechanism of the character described which readily accommodates vertical adjustment of the seat and/or pedal.

A still further object of the invention is to provide a control mechanism of the character described which is constructed simply and economically and which functions reliably over a long operating life.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views:

FIG. 1 is a fragmentary perspective view of a fishing boat which is equipped with a directional control mechanism in accordance with the present invention;

FIG. 2 is an enlarged fragmentary view taken in vertical section through the boat deck and directional control mechanism;

FIG. 3 is a cross sectional view taken generally along line 3—3 of FIG. 2 in the direction of the arrows; and FIG. 4 is a fragmentary sectional view on an enlarged scale taken generally along line 4—4 of FIG. 3 in the direction of the arrows.

Referring now to the drawing in more detail and initially to FIG. 1, reference numeral 10 generally designates a conventional electric trolling motor which is mounted on the bow of a fishing boat 11. The trolling motor 10 is an outboard motor which drives a propeller 12 in order to propel the boat through the water. The motor may be a sealed DC motor which is carried on the bottom end of a vertical shaft 13. Preferably, shaft 13 is vertically adjustable in order to vary the depth of the motor. Shaft 13 extends through a control housing 14 which is mounted to the bow of the boat by means of a bracket assembly 15. An elongate main control cable 16 extends into the control housing 14 and is coupled to the mounting shaft 13 in a manner such that extension and retraction of the cable rotates the shaft in order to vary the direction of the trolling motor 10.

The connection of the control cable 16 to shaft 13 may be effected in the manner disclosed in the Roller et al U.S. Pat. No. 3,889,625, or any other suitable manner. As best shown in FIG. 2, the control cable 16 includes a stationary sheath or cover **16*a* and an extensible and retractable cable wire 16*b* which extends through cover 16*a*. The cable wire 16*b* is a rather stiff wire which is able to slide axially within the cover 16*a* in order to vary the direction of motor 10** and thus the direction of travel of the boat.

An upper housing unit 18 is mounted on the top end of shaft 13. Electrical conductor wires 19 extend into housing 18 and through shaft 13 for connection with the motor 10. A battery (not shown) carried aboard the boat supplies electrical power to wires 19 for operation of the motor, as will be explained in more detail.

Referring additionally to FIG. 2, reference numeral 20 designates a conventional seat which is mounted on an upright stand 21 in a manner to swivel about the vertical axis of the stand. Stand 21 is mounted to extend upwardly from the boat deck 22. The seat 20 may be raised and lowered with respect to the boat deck, with a conventional clamp and collar assembly 23 providing such vertical adjustment.

As heretofore described, the trolling motor and seat assembly are conventional devices which have been employed on fishing boats.

In accordance with the present invention, a cylindrical control housing 25 is mounted on the boat deck 22 concentrically around the seat support stand 21. The control housing has an inwardly extending annular base portion 26 which is bolted or otherwise secured flatly on the deck to secure the housing in place. A cylindrical sleeve portion 27 of the housing is integral with base 26, extending upwardly from the inner edge thereof. The sleeve 27 is arranged concentrically about the upright seat stand 21 and is spaced outwardly thereof.

Contained between the outer housing 25 and the sleeve 27 is a cylinder 28 which is able to rotate relative to the control housing. The cylinder is concentric with stand 21. At its lower end, cylinder 28 has an inturned base portion **28*a* which is able to turn on top of the base portion 26 of the control housing. A bracket 29 mounted to portion 26 assists in maintaining base 28*a* in proper alignment while permitting it to freely rotate. A plastic sleeve 30 is fit tightly over and secured to cylinder 28 so that the cylinder and sleeve rotate in unison. A circular cover 31 is bolted at 32 to a thickened portion at the upper end of cylinder 28. A downturned skirt 31*a* on the periphery of the cover extends around housing 25** to assist in maintaining the rotative members in proper alignment with respect to the nonrotative housing assembly.

A mounting bracket 34 is secured to the underside of seat 20. The bracket carries a motor speed control knob 35 and an on-off switch 36 for the motor.

A brace 37 extends between bracket 34 and cover 31 to transmit rotational movement of the seat into rotational movement of cylinder 28. Arm 37 includes an upper tubular section 38 which is pivoted at 39 to bracket 34. The brace arm also has a lower rod portion 40 which fits into portion 38 in a telescoping manner in order to accommodate vertical adjustment of the seat. The lower end of rod 40 is pivoted at 41 to cover 31.

An adjustable bracket arm 42 is mounted to extend generally downwardly and forwardly from bracket 34. Arm 42 is adjustable in length, having an upper tube portion 43 into which a lower rod portion 44 fits in telescoping fashion. The tube 43 is connected to bracket 34 by a bolt 45. The rod 44 may be extended and retracted relative to tube 43 in order to adjust the length of bracket arm 42. A bolt 46 may be tightened down to rigidly connect members 43 and 44 to one another, with bolt 45 serving to rigidly mount the arm to the seat assembly.

A pedal lever 48 is carried on the lower end of bracket arm 42. Pedal 48 is pivotally mounted on the bracket arm by a horizontal pivot pin 49 which is located substantially centrally along the length of the pedal. The adjustable length of bracket arm 42 allows pedal 48 to be located conveniently for the fisherman sitting in the seat.

A stiff cable wire 50 connects to pedal 48 forwardly of the pivot axis 49. Wire 50 extends through a stationary cable cover 51 which is connected with a boss 52 formed on top of the housing cover 31. The cable cover 51 is secured to arm 42 by a ring 53. It is noted that clockwise pivoting of pedal 48 (as by depression of the toe of the fisherman) causes cable wire 50 to slide within cover 51 in a manner to retract out of the control housing 25. Conversely, counterclockwise pivoting of the pedal (as by depression of the heel of the fisherman) causes wire 50 to extend into the control housing.

The control wire 50 connects with a generally C-shaped yoke member 55 which is located within the control housing 25 and cylinder 28 but outwardly of sleeve 27. As best shown in FIG. 3, yoke 55 extends approximately halfway around sleeve 27 at an inclined angle and includes a pair of arms **55*a* which terminate at locations substantially diametrically across the sleeve. These arms 55*a* act essentially as levers, as will become clear. The central base area of the yoke 55 is pivotally connected to the rotative cylinder 28 by a horizontal pivot pin 56 (FIG. 2) which mounts the yoke to the cylinder such that they rotate in unison. Cable wire 50 connects with the end of one of the arms 55*a* and consequently, extension and retraction of the wire causes yoke 55 to pivot about its horizontal axis 56**.

The end of each yoke arm **55*a* carries a roller 58. The rollers 58 rotate around a nonrotating ring 59 which is fit around the housing sleeve 27 and is able to slide in linear movement upwardly and downwardly thereon. Upper and lower flanges 59*a* extend outwardly from the ring to provide a track in which the rollers are able to move around the ring. It should be apparent that upward and downward pivoting of yoke 55 as caused by extension and retraction of wire 50 causes ring 59** to slide upwardly and downwardly within the control housing.

Three intermediate control wires 60 connect with the bottom of ring 59. Wires 60 are rather stiff, and they connect with the ring at equally spaced intervals around its circumference, as best shown in FIG. 3. The intermediate wires 60 extend slidably through the boat deck 22, below which they enter stationary wire covers 61 which are mounted at 62 to the underside of the deck. The opposite ends of covers 61 connect with a mounting bracket 63 which is secured to the underside of the deck by bolts 64. Within the mounting bracket 63, wires 60 connect with a plate 65 at spaced apart locations thereon. The main control cable **16*b* previously described also connects with plate 65. As a result, extension and retraction of wires 60 is translated into corresponding motion of the main cable 16*b*. The stationary main cable cover 16*a* connects with bracket 63 and extends upwardly through the deck to connection with housing 14 (FIG. 1**).

The conductor wires 19 which lead to motor 10 also connect with a plurality of electrically conductive brushes 67 which are best shown in FIGS. 2 and 4. With particular reference to FIG. 4, each brush 67 is mounted to slide axially within a sleeve 68 which is rigidly secured to the control housing 25. The conductor wires 19 enter the end of sleeve 68 and connect with the respective brushes 67. A compression spring 69 is fit within each sleeve 68 to act on the brushes in a manner continuously urging them inwardly. This inward biasing force on the brushes maintains them in sliding contact with electrically conductive straps 70 which are secured to extend around the plastic sleeve 30. Straps 70 are preferably located within recessed areas of sleeve 30 and extend completely around the same so that the straps remain in continuous contact with brushes 67 as the sleeve rotates with cylinder 28. A conductor wire 71 leads from each strap 70 to connection with the control knob 35 and the on-off switch 36 (see FIG. 2).

A wire 71*a* (FIG. 2) leads from its strap 70 to connection with a foot operated button type switch 71*b* which is carried on pedal 48. Switch 71*b* is an on-off switch for the trolling motor and may be depressed to switch the motor on and off. Wire 71*a* is connected to arm 42 by ring 53.

Additional electrical wiring 72 (FIG. 2) connects with brushes 67 and leads to the battery (not shown) which is carried on board the boat. Current may thus be supplied from the battery through wire 72 to the stationary brushes 67, to the rotating straps 70, through wires 71 and 71*a* to the speed control knob 35 and switches 36 and 71*b*, back through wires 71 and 71*a* to the straps and brushes, and through wires 19 to the trolling motor 10. Additional wiring (not shown) leads directly between the battery and motor.

To change the direction of travel of the boat, the fisherman sitting on seat 20 needs only to pivot pedal 48 in the proper manner. Depression of the pedal with the toe causes it to pivot in a manner extending cable wire 50 out of the control housing 25. Yoke 55 essentially detects this motion of the wire, and the resulting upward pivotal movement of yoke 55 raises ring 59, which in turn pulls the intermediate wires 60 upwardly and causes extension of the main cable wire 16*b* out of its control housing 14. Conversely, depression of pedal 48 by the heel causes retraction of wire 50 into housing 25 and downward pivoting of yoke 55. As ring 59 is thereby pushed downwardly, wires 60 are pushed in a manner to cause retraction of cable 16*b* into housing 14, thereby turning shaft 13 in a direction opposite that resulting from depression of pedal 48 by the toe.

When seat 20 is rotated about the vertical axis of stand 21 to permit fishing in a different direction, the rigid bracket arm 42 assures that pedal 48 will rotate with the seat and thus remain conveniently located to the fisherman. Brace arm 37 assures that the rotatable assembly, including cylinder 28 and yoke 55, rotates in unison with the seat. Rollers 58 are able to smoothly roll around the track provided on ring 59 so that rotative movement of the seat has no effect on the stationary components or the control cables. At the same time, the sliding contact between brushes 67 and straps 70 maintains the necessary electrical connections during rotational movement of the seat.

The provision of a pair of diametrically opposed lever arms 55*a* on the yoke 55 is important in maintaining the proper orientation of ring 59 at all times. The upward and downward forces which are applied on the ring are exerted at generally diametrically opposed positions so that the ring will not become skewed or otherwise misaligned on sleeve 27.

The use of three equally spaced intermediate wires 60 is also important in achieving proper directional control of the trolling motor. Regardless of the location of the yoke 55, rollers 58 will always be relatively close to two of the wires 60, so that those two wires will be raised or lowered properly even if ring 59 should become misaligned or if another malfunction should occur. Consequently, plate 65 will be acted upon as intended by at least two of the wires, and the main cable 16*b* will be extended or retracted accordingly.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or show in the accompanying drawing is to be interpreted as illustrative and not in a limiting sense.

Having thus described the invention, we claim:

1. A control mechanism for a boat having a seat assembly supported to rotate about a generally vertical axis and an outboard motor which is directionally controlled by extension and retraction of a control cable, said control mechanism comprising:
   - a pedal;
   - means mounting said pedal at a location below the seat assembly for rotation therewith and for pivotal movement about a generally horizontal axis;
   - a control wire coupled with said pedal in a manner to extend and retract in response to pivotal movement of the pedal;
   - a control lever mounted to rotate with the seat assembly and to pivot about a pivot axis, said control wire connecting with said lever at a location offset from its pivot axis to thereby effect pivotal movement of said lever in response to extension and retraction of said wire; and
   - means translating pivotal movement of said lever into extension and retraction of said control cable.

2. A control mechanism as set forth in claim 1, wherein said mounting means includes:
   - a bracket extending generally downwardly from said seat assembly and carrying said pedal at a location below the seat assembly; and
   - means for adjusting the length of said bracket to vary the distance of said pedal below the seat assembly.

3. A control mechanism as set forth in claim 1, wherein said translating means includes:
   - a nonrotatable ring member supported for substantially linear movement;
   - means coupling said lever with said ring member for rotation relative thereto and in a manner to effect linear movement of said ring member as said lever pivots about its pivot axis; and
   - means coupling said ring member with said control cable in a manner to extend and retract the cable as said ring member moves linearly.

4. A control mechanism as set forth in claim 3, including roller means interposed between said lever and ring member.

5. A control mechanism as set forth in claim 1, wherein the motor is an electric motor, and including:
   - a first set of conductor wires connected with the motor for carrying electrical current;

a second set of conductor wires carried on the seat assembly and rotating therewith to deliver current to equipment carried on the seat assembly;

a cylinder having an electrically conductive portion connected with the second set of wires, said cylinder being arranged substantially concentrically with the rotational axis of the seat assembly and mounted to rotate with same; and means establishing sliding electrical contact between the conductive portion of said cylinder and the first set of conductor wires.

6. A control mechanism for a boat having a seat assembly supported to rotate about a generally vertical axis and an outboard motor which is directionally controlled by extension and retraction of a control cable, said control mechanism comprising:

a pedal;

means mounting said pedal at a location below the seat assembly for rotation therewith and for pivotal movement about a generally horizontal axis;

a control wire coupled with said pedal in a manner to extend and retract in response to pivotal movement of the pedal;

a pair of spaced apart levers mounted to pivot about a common pivot axis and to rotate with said seat assembly, said control wire acting to pivot said levers as the wire extends and retracts; and a ring member supported for generally vertical movement and substantially centered on the rotational axis of said seat assembly, said levers being rotatable around said ring member and engaging same at spaced locations in a manner to effect vertical movement of said ring member in response to pivotal movement of the levers, said ring member being operable upon vertical movement thereof to extend and retract said control cable.

7. A control mechanism as set forth in claim 6, including:

a roller carried on each of said levers; and means providing a track around said ring member in which said rollers act, said rollers applying raising and lowering forces to said ring member upon pivotal movement of said levers.

8. A control mechanism as set forth in claim 6, including:

a plurality of intermediate cables connected with said control cable and with said ring member at substantially equidistantly spaced locations on the latter.

9. A control mechanism for a boat having a seat assembly supported to rotate about a generally vertical axis and an outboard electric motor which is directionally controlled by extension and retraction of a control cable, said control mechanism comprising:

a pedal;

means mounting said pedal at a location below the seat assembly for rotation therewith and for pivotal movement about a generally horizontal axis;

a control wire coupled with said pedal in a manner to extend and retract in response to pivotal movement of the pedal;

means coupling said control wire with said control cable such that extension and retraction of said wire is translated into extension and retraction of said cable, thereby providing directional control of the motor through pivotal movement of said pedal;

a first set of conductor wires connected with the motor for carrying electrical current;

a second set of conductor wires carried on the seat assembly and rotating therewith to deliver current to equipment carried on the seat assembly;

a cylinder having an electrically conductive portion connected with the second set of wires, said cylinder being arranged substantially concentrically with the rotational axis of the seat assembly and mounted to rotate with same; and means establishing sliding electrical contact between the conductive portion of said cylinder and the first set of conductor wires.

10. A control mechanism as set forth in claim 9, including:

a stationary housing mounted to the boat and containing said cylinder;

a plurality of conductive rings mounted in extension around said cylinder and contacting said second set of wires; and a plurality of conductive brushes supported on the housing and urged against said rings in sliding contact therewith, said first set of wires connecting to said brushes.

11. A control mechanism as set forth in claim 9, including a bracket extending between said seat assembly and cylinder to transmit rotational movement of the seat assembly into corresponding rotation of the cylinder, and means for adjusting the length of said bracket to permit raising and lowering of the seat with respect to said cylinder.

12. A directional control mechanism for a boat having a seat assembly supported to rotate about a generally vertical axis and an outboard propulsion unit mounted to pivot in a manner to vary the direction of travel of the boat, said mechanism comprising:

a pedal carried on said seat assembly for rotation therewith and mounted to pivot about a generally horizontal axis;

a rotatable member coupled rigidly with said seat assembly for rotation directly therewith about said vertical axis;

a control wire extending from said pedal and supported to extend and retract in response to pivotal movement of the pedal, said control wire having an end connected with said rotatable member, whereby the entirety of said wire rotates with said seat assembly and rotatable member, said wire maintaining a fixed relationship with said seat assembly and rotatable member during rotation of the seat assembly; and means translating extension and retraction of said control wire into pivotal movement of said propulsion unit.

* * * * *